US007628465B2

(12) United States Patent
Aruga

(10) Patent No.: US 7,628,465 B2
(45) Date of Patent: Dec. 8, 2009

(54) IMAGE RECORDING APPARATUS AND IMAGE RECORDING METHOD

(75) Inventor: Toshinao Aruga, Tokyo (JP)

(73) Assignee: Olympus Corporation, Tokyo (JP)

( * ) Notice: Subject to any disclaimer, the term of this patent is extended or adjusted under 35 U.S.C. 154(b) by 345 days.

(21) Appl. No.: 11/811,970

(22) Filed: Jun. 13, 2007

(65) Prior Publication Data

US 2007/0291060 A1 Dec. 20, 2007

(30) Foreign Application Priority Data

Jun. 20, 2006 (JP) ..... 2006-169851

(51) Int. Cl.
*B41J 29/393* (2006.01)

(52) U.S. Cl. ..... 347/19; 347/12

(58) Field of Classification Search ..... 347/12, 347/15, 19; 358/504
See application file for complete search history.

(56) References Cited

U.S. PATENT DOCUMENTS 6,554,387 B1 * 4/2003 Otsuki ..... 347/19
7,168,775 B2 * 1/2007 Kuruma et al. ..... 347/14

FOREIGN PATENT DOCUMENTS

JP 2004-034650 A 2/2004

* cited by examiner

*Primary Examiner*—Lamson D Nguyen
(74) *Attorney, Agent, or Firm*—Frishauf, Holtz, Goodman & Chick, P.C.

(57) ABSTRACT

This is an imaging apparatus having at least one recording unit arraying a plurality of nozzle arrays featured with a plurality of nozzles for jetting a single color ink onto a recording medium, and recording an image onto the recording medium by correcting a recording timing of each of the corresponding plurality of nozzle arrays by using individual correction parameter considering the individual characteristic of each of the plurality of nozzle arrays.

8 Claims, 14 Drawing Sheets

IMAGE RECORDING APPARATUS AND IMAGE RECORDING METHOD

CROSS REFERENCE TO RELATED APPLICATIONS

This application claims benefit of Japanese Application No. 2006-169851 filed Jun. 20, 2006, the contents of which are incorporated by this reference.

BACKGROUND OF THE INVENTION

1. Field of the Invention

The present invention relates to an image recording apparatus comprising at least one recording unit equipped with a plurality of nozzle arrays featured with a plurality of nozzles for jetting a single color ink to a recording medium and recording an image by means of a relative move between the recording medium and recording unit, and in more specific, to a correction technology for an image recording by an image recording apparatus comprising a plurality of short recording head having a nozzle array or a long recording unit (i.e., a line head) by arraying a plurality of nozzle arrays.

2. Description of the Related Art

An inkjet recording method is known as a recording method by using an image recording apparatus recording an image on a recording medium by jetting ink from each nozzle array of a nozzle array featured with a plurality of nozzles. Such an inkjet recording method applying pressure to ink in an ink fluid chamber in accordance with record information (i.e., record data) by using an ink fluid chamber and a recording head featured with nozzles connected to the ink fluid chamber, thereby jetting an ink droplet from the nozzle and recording an image by fixing the ink droplet onto a recording medium such as paper and film.

On the recording head, there is a trend of multiplication of recording elements (i.e., jet nozzles) and that of elongation of a nozzle array in order to satisfy a demand for speeding up the image recording.

A configuration arraying (i.e., featuring) a plurality of jet nozzles across the entirety of one side of a recording medium, that is, using a line head, is known as an image recording apparatus satisfying such a demand for elongating a nozzle array.

A full line type image recording apparatus using the line head is capable of recording an image on the entire surface of a recording medium just by relatively moving the recording medium and the line head in the direction perpendicular to the array direction of nozzles of the aforementioned line head. Therefore, the full line type image recording apparatus using the line head is capable of recording an image rapidly by a simple operation requiring no movement of a carriage comprising a recording head or an intermittent conveying of a recording medium such as a serial type image recording apparatus.

A line head, however, has a shortfall such as a higher cost, lower production yield and lower reliability than a short recording head.

What is known as an inkjet image recording apparatus solving these problems is a configuration using a line head arraying a plurality of nozzle arrays featured with a plurality of nozzles across a length of no less than the width of a recording medium or with a short recording head comprising the aforementioned nozzle array in the arraying direction of the nozzle array. In such an inkjet image recording apparatus, the advantages such as cost, production yield and reliability by using a short recording head are provided and furthermore the advantage of a high speed image recording by using a line head is also provided.

Also, such an inkjet image recording apparatus performs a relative move (i.e., a move of a recording medium) between the recording medium and the nozzle array of the line head in an approximate fixed velocity usually by using a motor and drives a plurality of nozzles comprising a nozzle array constituting the line head respectively on the basis of the recorded data, thereby performing a dot recording (i.e., an image recording) on a recording medium.

Incidentally, an encoder is usually used for relative position detection and a move velocity control between the recording medium and line head.

Here, if a recording medium on which an image is recorded by the inkjet image recording apparatus is a continuous sheet such as a roll paper, a running start time extending in a large period of time before the conveying velocity of the roll paper reaches at a prescribed fixed velocity.

In order to make the conveying velocity of the roll paper a prescribed fixed velocity in a short period time (i.e., a small running start time), a large conveying drive power is required, facing a large scale of equipment and a high cost thereof.

Meanwhile, in a method of setting a large running start time before the conveying velocity of the roll paper reaches at a prescribed fixed velocity for avoiding a large scale of equipment and a high cost thereof, a high running cost is ushered in due to an increase of an area at the head part of the roll paper, et cetera, where an image recording is not possible, and also a problem of a reduced throughput of the image recording equivalent to an extended running start time.

And the above described serial type image recording apparatus is configured to make the carriage stop once at both ends of the carriage movement range and move in the reverse direction, and therefore set the both end zones of the movement range as acceleration/deceleration area and make the area between the both end areas as a fixed velocity area. Therefore, the serial type image recording apparatus treats only the section of the fixed velocity area as the recording area and therefore is faced with the problem that an image recording time is extended in the amount of time required for moving to the acceleration/deceleration area at both ends of the fixed velocity area and also that the equipment becomes large as much as securing a space for the acceleration/deceleration area.

Consequently, what is desired of the inkjet image recording apparatus of which a recording medium is a continuous sheet such as a roll paper is a capability of recording an image not only in the fixed velocity area, but also in the acceleration area or deceleration area, of the relative move between the recording head and recording medium.

In the meantime, an encoder comprised by an inkjet image recording apparatus comprises the function of generating a timing (i.e., a recording timing) at the time of having the nozzle array of the recording head jetting an ink droplet onto a recording medium.

Making a higher resolution of an encoder ushers in a cost increase of equipment, and therefore a resolution of an encoder output from the encoder used for generating a recording timing is usually lower than a dot density to be recorded. The resolution is expressed by the unit of dpi (a dot per inch) and, as an example, a recording resolution is in the neighborhood of 600 dpi to 1200 dpi for an encoder output of 150 dpi. Thus, because the recording resolution is higher than the resolution of the encoder output, it needs to be multiplied by some method in order to generate a recording timing based on the encoder output.

As one example of a conventional technique of the kind, a reference patent document 1 (i.e., a Laid-Open Japanese Patent Application Publication No. 2004-34650) has disclosed a serial type inkjet image recording apparatus which is configured to obtain an amount of correcting a position caused by a velocity of a carriage while considering an inertial move due to a movement of the carriage at the time of a jetted ink droplet flying toward the recording medium.

FIG. 1 illustrates the method for calculating a position correction amount disclosed in the patent document 1.

Referring to FIG. 1, shown is how the positions of an ink droplet 3 is shifted by a relative move between a nozzle array 1 and a recording medium 2 when flying from the nozzle array 1 toward the recording medium 2.

While the nozzle array 1 moves at the move velocity Vs in the relative move direction (of the x direction), the ink droplet 3 is jetted to the direction (of the z direction) of the recording medium at the velocity Vd. The ink droplet 3 is flown in the direction of a resultant vector of these directions. Therefore, defining the distance between the nozzle array 1 and recording medium as G, the shift amount dx of a position of ink landing relative to the position of ink ejection in the x direction is expressed by the expression (1)

$$dx=(G/Vd)\times Vs \quad (1)$$

Meanwhile, the technique put forth in the patent document 1 is configured to include an encoder for detecting a displacement of a carriage, a first counter for obtaining first position information by counting output pulses of the encoder and a second counter for obtaining second position information by counting output pulses of the encoder or counting pulses as the result of dividing the first position information as a configuration for detecting a position of a recording head.

Therefore, the inkjet recording apparatus according to the patent document 1 is capable of obtaining an appropriate position correction amount even if the speed of the carriage is changed (i.e., an acceleration and deceleration), and generating a recording timing signal in a higher frequency than an encoder frequency by generating a multiplied signal of the encoder output.

In an inkjet recording apparatus configured to array a plurality of short recording heads for jetting a single color ink, however, requires equipment of a number of recording heads with respectively different jet characteristics, and therefore a recording of an image requires a consideration of a difference in jet characteristic of each recording head and that of a change in recording density due to a mounting error of a plurality of short recording heads.

FIG. 2 exemplifies a configuration of a line head arraying a plurality of short recording heads for jetting a single color ink.

FIG. 2 shows a positional relationship between a recording medium 2 and a single color recording unit (i.e., a line head) arraying six short recording heads 11-1 through 11-6 (which are enclosed the by double-chain lines in the drawing) in the nozzle array direction (i.e., the x direction) staggeringly by separating them by the distance of dh in the conveying direction (i.e., the y direction).

In the inkjet recording apparatus comprising such a recording unit 12 for each color ink, if it is configured to array a plurality of recording units 12 for each ink color by separating in the conveying direction of the recording medium 2, an image is recorded at a recording timing at which a plurality of nozzles in each recording unit 12 is opposite a prescribed position of the recording medium 2.

FIG. 3A shows each conveying velocity of a recording medium 2 at a full line type image recording apparatus conveying the recording medium 2 in three kinds of relative move velocity areas (i.e., an acceleration area, a fixed velocity area and a deceleration area) relative to a recording unit 12 fixedly arraying the present recording unit 12 as shown in FIG. 2. Note that FIG. 3A shows the case of starting a record in the middle of the acceleration area and continuing it to the fixed velocity area, followed by ending the recording in the middle of the deceleration area.

Meanwhile, FIG. 3B illustrates a shift between the landing position on the recording medium 2 and the jetting position of a nozzle array at the time of the ink flying from the present nozzle array toward the recording medium 2 during the movement of the recording medium 2 at each of the above described relative speeds relative to the nozzle array of the recording unit 12.

FIG. 3B shows the fact that a shift amount between the jet position of the nozzle array and the landing position onto the recording medium 2 is changed in accordance with the relative move velocity (i.e., the velocity of the recording medium 2).

While the above described expression (1) has been described by exemplifying a serial scan type image recording apparatus in which the nozzle array moves, a replacement of the velocity Vs of the expression (1) with the conveying velocity of the recording medium makes it possible to calculate, by using the expression (1), a shift amount dy of the ink landing position in the relative move direction (i.e., the y direction) for a full line type image recording apparatus arraying fixedly the recording unit 12 as shown in FIG. 2.

As an example, calculating the dy by using the expression (1) in the following condition of:

relative move velocity Vs: 1 m/sec, flying velocity of an ink droplet Vd: 10 m/sec, and the distance between nozzle array and recording medium G: 2 mm, then the shift amount dy in the relative move direction (i.e., the y direction): 200 micrometers.

The shift amount in the relative move direction calculated as described above is different among each of the above described relative move velocity areas (i.e., an acceleration area, a fixed velocity area and a deceleration area). If recorded by the above described full line type image recording apparatus in the acceleration area for example, the shift amount in the relative move direction is different with the relative move velocity of individual arraying position of the nozzle array, because the nozzle array of the short recording head for jetting a single color ink is arrayed separately in the front and rear (i.e., the upstream and downstream sides) of the conveying direction of the recording medium 2.

Meanwhile, when fixedly arraying the recording unit 12 as shown in FIG. 2 in the above described full line type image recording apparatus, a high precision adjustment mechanism is required to make the angle of a jet direction from each nozzle of the short recording heads 11-1 through 11-6 for example of the recording unit 12 entirely uniform and array, without allowing an error, the respective nozzle head parts separately arrayed in the front and rear of the conveying direction of the recording medium 2 so as not to overlap with one another when viewed in the y direction for example.

Also, the short recording heads 11 constituting such a recording unit 12 employs such as a method of using a piezoelectric element (PZT) that is an electro-mechanical transducer and of using a heat generated by a thermal resistor such as a thermal inkjet as the method for applying pressure to the ink in an ink fluid chamber. The nozzle array of the short recording head 11 is extremely finely formed, that is, the nozzle density of 150 to 600 dpi and the number of nozzles of several hundreds. This makes it extremely difficult to produce all the nozzles of the short recording head 11 uniformly in a nozzle plate. In a short recording head 11 using a PZT for example, a variation of jet velocity of each nozzle of each of short recording heads 11 may be generated by the material and/or process accuracy of the PZT.

There is a risk of the shift amount dy in the neighborhood of 10% in the relative move direction being generated by a variation of each nozzle array due to various causes. Because of this, if the shift amount in the relative move direction (i.e., the y direction) for example is 200 micrometers, the variation for each nozzle array is 20 micrometers. If such a full line type image recording apparatus records at the recording resolution of 600 dpi, there is a risk of an ink landing position shifting approximately by a half of the recording dot interval due to a variation of each nozzle array since the recording dot interval is approximately 42 micrometers.

Such a shift of an ink landing position of each nozzle array constitutes a cause for a non-uniform color due to a misalignment of overlapped colors especially for a full line type image recording apparatus arraying a plurality of the recording units 12 for each color of ink.

SUMMARY OF THE INVENTION

An image recording apparatus as one of aspects of the present invention is one having at least one recording unit arraying a plurality of nozzle arrays featured with a plurality of nozzles for jetting a single color ink onto a recording medium and recording an image by relatively moving the recording unit and the recording medium, comprising: a parameter memory unit for storing an individual correction parameter considering an individual characteristic of each of the plurality of nozzle arrays; and a recording timing correction unit for individually correcting a recording timing of the corresponding each of the plurality of nozzle arrays by using the correction parameter read out of the parameter memory unit.

An image recording method as one of aspects of the present invention is the method for use in an image recording apparatus having at least one recording unit arraying a plurality of nozzle arrays featured with a plurality of nozzles for jetting a single color ink onto a recording medium and recording an image by relatively moving the recording unit and the recording medium, comprising: correcting a recording timing of the corresponding each of plurality of nozzle arrays by using an individual correction parameter considering the individual characteristic of each of the plurality of nozzle arrays; and recording an image at the present recording timing corrected for each of the plurality of nozzle arrays.

DESCRIPTION OF THE PREFERRED EMBODIMENTS

The following is a detailed description of the preferred embodiment of the present invention by referring to the accompanying drawings.

Figure 4:
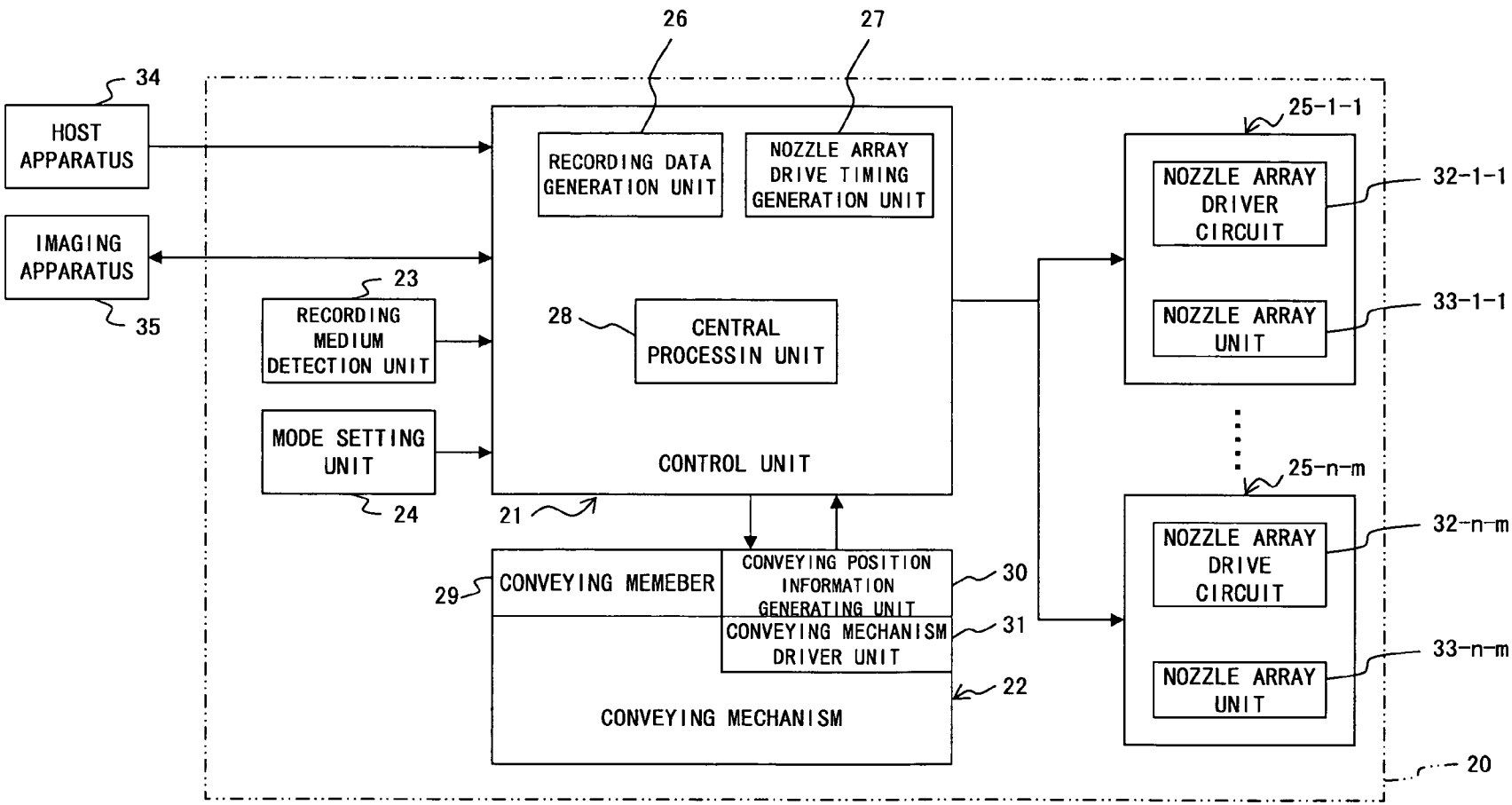
FIG. 4 is a diagram exemplifying a conceptual configuration of an image recording apparatus according a preferred embodiment of the present invention.

FIG. 4 is a diagram exemplifying a conceptual configuration of an image recording apparatus according a preferred embodiment of the present invention.

Figure 5:
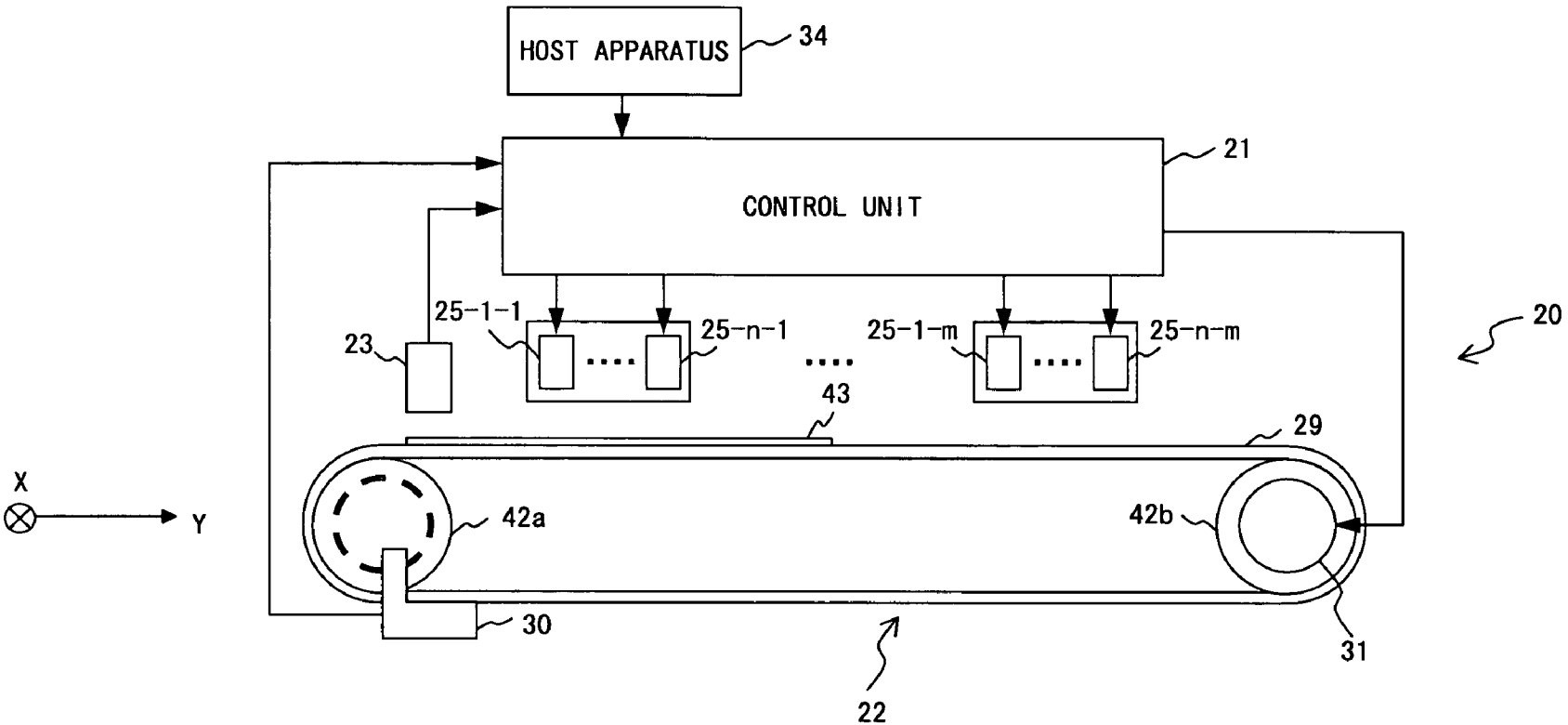
FIG. 5 is a diagram illustrating an example of a layout of constituent components of an image recording apparatus premising a recording medium such as cut paper, et cetera.

FIG. 5 is a diagram illustrating an example of a layout of constituent components of an image recording apparatus premising a recording medium such as cut paper, et cetera.

Note, while FIG. 5 shows an example of a layout of constituent components of an image recording apparatus premising a recording medium such as cut paper, et cetera; the present invention, however, is applicable to a continuous sheet such as a roll sheet, et cetera, in place of the recording medium such as cut paper, et cetera, in lieu of being limited to the example put forth herein.

The image recording apparatus 20 shown in FIG. 5 comprises at least a control unit 21, a conveying mechanism 22, a recording medium detection unit 23, a mode setting unit 24 and recording units 25-1 through 25-n-m. The recording units 25-1-1 through 25-n-m each comprises at least one nozzle array featured with a plurality of recording elements (i.e., nozzles), in a nozzle plate, for jetting ink.

The control unit 21 is for controlling the entirety of the image recording apparatus 20, and comprises a recording data generation unit 26, a nozzle array drive timing generation unit 27 and a central processing unit 28.

The control unit 21 is connected to the recording units 25-1-1 through 25-n-m, the recording medium detection unit 23 for detecting a head position of a recording medium 43, the mode setting unit 24 for setting an image recording mode, and such, and the conveying mechanism 22 for conveying the recording medium 43, respectively.

Figure 1:
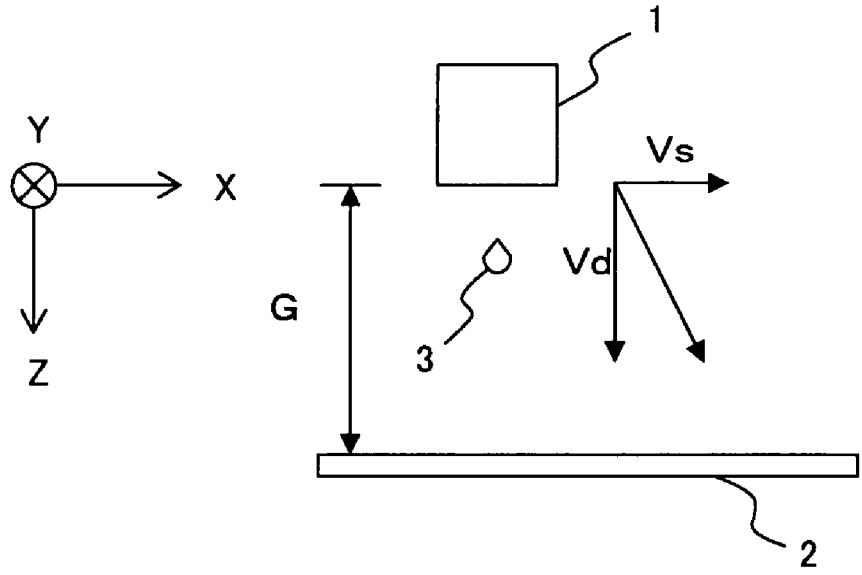
FIG. 1 is a diagram illustrating the method for calculating a position correction amount disclosed in the patent document 1.
Figure 2:
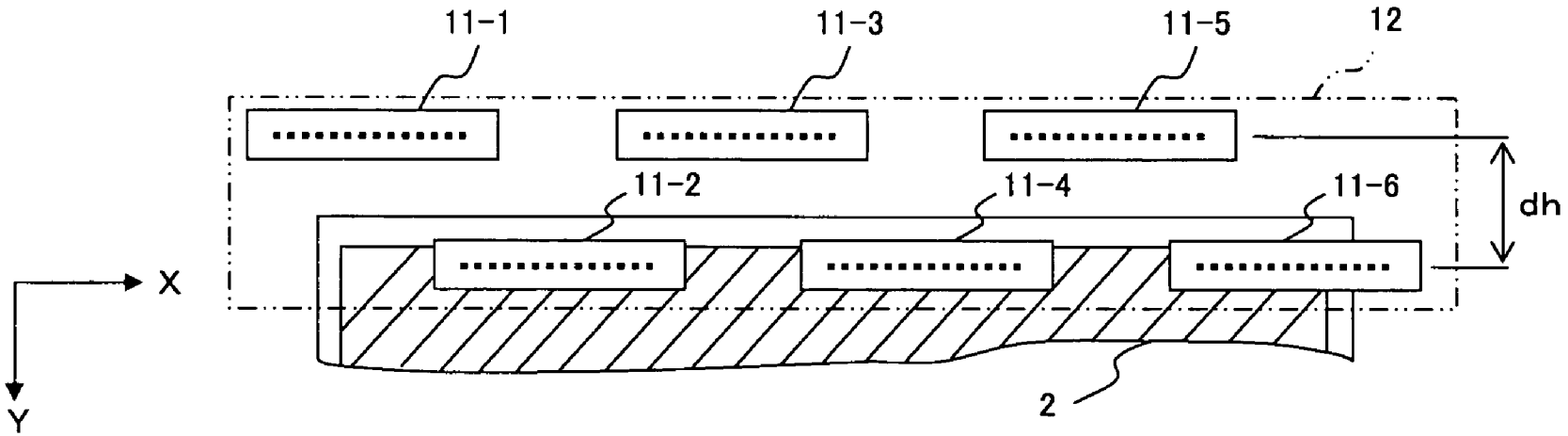
FIG. 2 is a diagram exemplifying a configuration of a line head arraying a plurality of short recording heads for jetting a single color ink.
Figure 3A:
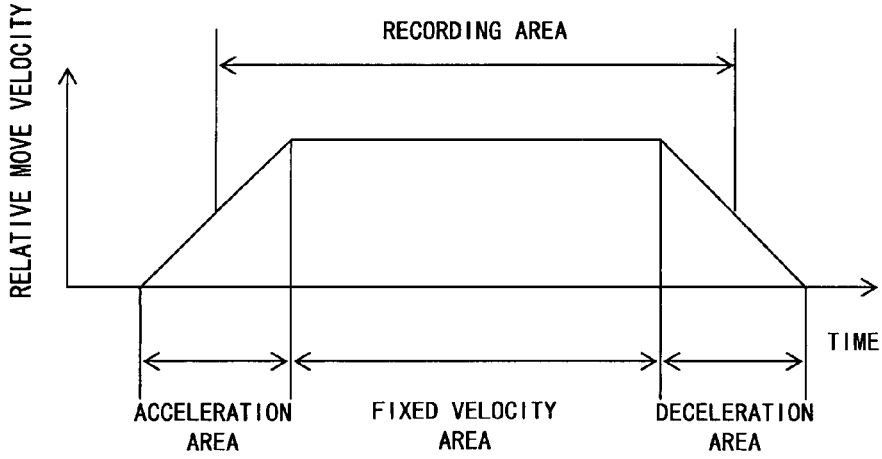
FIG. 3A is a diagram showing the case of starting a record in the middle of an acceleration area and continuing it to a fixed velocity area, followed by ending the recording in the middle of the acceleration area.
Figure 3B:
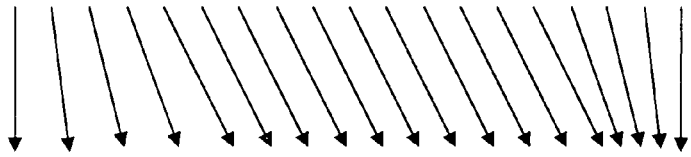
FIG. 3B is a diagram illustrating a shift between the landing position on a recording medium 2 and the ejection position (i.e., the jetting position) of a nozzle array at the time of the ink flying from the present nozzle array toward the recording medium during the movement of the recording medium at each relative velocity relative to the nozzle array.

The recording data generation unit 26 temporarily stores recording data transferred from a host apparatus such as a host computer and generates individually divided recording data which is a result of correlating the stored recording data with the placement of the respective nozzle array as shown in the above described FIG. 2.

The recording data generation unit 26 also correlates information of a storage delay process with divided recording data corresponding to each nozzle array placed on the downstream side of the recording medium in the conveying direction.

Note that the individual nozzle arrays placed on the downstream side of the recording medium 43 in the conveying direction are equivalent to the individual nozzle array of the short recording heads 11-2, 11-4 and 11-6 which are shown in the above described FIG. 2, of which pieces of basic information of the storage delay process that are respectively correlated are equivalent to the intervals dh between the individual nozzle arrays of the short recording heads 11-1, 11-3 and 11-5 and those of the short recording heads 11-2, 11-4 and 11-6.

Note that the recording data generation unit 26 is described in detail later.

The nozzle array drive timing generation unit 27 generates a drive timing for each of nozzle arrays 33-1-1 through 33-n-m and notifies each of them of a recording instruction at the generated drive timing, thereby controlling the ink jetting of each of them. The central processing unit 28 controls integrally the image signal process of the control unit and the entirety of the image recording apparatus 20.

The conveying mechanism 22 comprises a conveying member 29 for placing and retaining the recording medium 43, a conveying position information generation unit 30 for generating conveying information of the recording medium 43 and a conveying mechanism drive unit 31 for driving the conveying member 29.

The conveying mechanism 22 is configured to install, around rollers 42*a* and 42*b*, an endless belt used for the conveying member 29 placing the recording medium 43 for example. The roller 42*a* is equipped with a rotary encoder for example used at the conveying position information generation unit 30 and a pulse signal corresponding to the movement amount of the endless belt is generated and reported to the control unit 21. And the roller 42*b* is configured to be equipped with a motor for example used at the conveying mechanism drive unit 31 and to drive the endless belt based on an instruction of the control unit 21.

This makes the conveying mechanism 22 place and retain the recording medium 43 on the conveying member 29 based on an instruction of the control unit 21 and convey the recording units 25-1-1 through 25-n-m toward the downstream of the nozzle array.

The recording medium detection unit 23 is for detecting a position of the recording medium 43, such as a cut sheet of paper, conveying within a conveying path, is constituted by a line sensor (e.g., a charge-coupled device (CCD) sensor) for example and notifies the control unit 21 of edge detection information of the recording medium 43 in the conveying direction and notifies of detection information at both edge of the recording medium 43 in the direction perpendicular to the conveying direction.

The recording medium detection unit 23 also is constituted by a rotary encoder, for example, for generating a pulse signal in accordance with a conveying distance (i.e., a movement amount) of a continuous sheet if the recording medium 43 is the continuous sheet such as a roll paper in place of a cut sheet or such, and notifies the control unit 21 of the movement information of the continuous sheet.

The mode setting unit 24 is equipped as a part of an input operation panel for the entirety of the image recording apparatus 20 or as an input operation panel of a different configuration from the aforementioned configuration. Alternatively, the mode setting unit 24 may be equipped, by using a program (i.e., by installing it), in an operation screen of a host apparatus 34, such as a host computer for example, as an external apparatus, for notifying the image recording apparatus 20 of a series of conditions (i.e., job information) related to recording an image, including record data.

An operator inputs an operation instruction from the mode setting unit 24, thereby setting, in the image recording apparatus 20, an image recording mode related to a correction according to the present embodiment such as a selection of a recording velocity mode and information of a thickness of the recording medium 43. And the image recording apparatus 20 selects and calculates the most optimal recording timing correction parameter based on the set image recording mode.

Note that the recording timing correction is described in detail later.

Each of the recording units 25-1-1 through 25-n-m comprises an image recording unit for recording an image on the recording medium 43 based on a control instruction of the control unit 21 which has received a notification of a series of conditions (i.e., job information) and record data related to an image recording from the host apparatus 34. The recording units 25-1-1 through 25-n-m comprise a plurality of nozzle arrays 33-1-1 through 33-n-m, and nozzle array driver circuits 32-1-1 through 32-n-m for driving a plurality of nozzles of the plurality of nozzle arrays 33-1-1 through 33-n-m, respectively. The signs "n" and "m" of the recording units 25-1-1 through 25-n-m and the nozzle arrays 33-1-1 through 33-n-m are integers of no less than "2", with the "n" being equivalent to the number of nozzle arrays constituting the recording unit (i.e., the line head) and the "m" being equivalent to the number of colors of ink of the image recording apparatus 20.

The recording units 25-1-1 through 25-n-m comprise a line head constituted by a plurality of nozzle arrays having a piezoelectric element (PZT) that is an electromechanical transducer, or by a plurality of short recording heads having a similar piezoelectric element, which applies pressure to the ink in an ink fluid chamber in the recording elements (i.e., the nozzles).

In the line head, the recording units 25-1-1 through 25-n-m are specifically configured such that, as an example, mutually adjacent pair of ends of a plurality of nozzle arrays are placed in a straight line in the direction approximately perpendicular to the conveying direction of the recording medium 43, or the mutually adjacent pair of ends of a plurality of nozzle arrays are placed apart by a prescribed distance in the conveying direction of the recording medium 43. Also in the line head, the recording units 25-1-1 through 25-n-m are specifically configured such that, as an example, mutually adjacent pair of ends of nozzle arrays of a plurality of short recording heads having a nozzle array are placed in a straight line in the direction perpendicular to the conveying direction of the recording medium 43, or the mutually adjacent pair of ends of nozzle arrays of a plurality of short recording heads having a nozzle array are placed apart by a prescribed distance in the conveying direction of the recording medium 43.

An image recording by the recording units 25-1-1 through 25-n-m is carried out by divided recording data which is a result of dividing, into a piece of recording data for each of the nozzle arrays constituting the line head, the recording data of one ("1") through "n" lines (where the n is an integer of no less than "2") in the recording data notified from the host apparatus 34 to the control unit 21.

An example of the present embodiment is configured to record an image by jetting ink of individual colors from a plurality of nozzles in the nozzle arrays 33-1-1 through 33-n-m, respectively, of the individual line head corresponding to the four color inks, e.g., black (K), cyan (C), magenta (M) and yellow (Y).

The nozzle arrays 33-1-1 through 33-n-m when placing a four-color line head as described above, have the number of total nozzle arrays n of twenty four, with the total number of colors m being four, if a single line head for a single color is configured as shown in FIG. 2 for example.

In the image recording apparatus 20 configured as placing four-color line heads as described above, the control unit 21 generates eight kinds of recording timings corresponding to the nozzle arrays 33-1-1 through 33-24-4 of each line head based on a pulse signal of the rotary encoder at the conveying position information generation unit 30 taking the notification information from the above described recording medium detection unit 23 as trigger information.

An imaging apparatus 35, being connected to the image recording apparatus 20, is an external apparatus including a scanner detecting a position of an image by reading the image on the recording medium 43 and notifies the control unit 21 of position information of an image recorded of the recording medium 43 which is set in the apparatus itself based on an instruction of the control unit 21 for example.

Note that FIG. 4 shows a configuration in which the image recording apparatus 20 and imaging apparatus 35 as separate apparatuses; a preferred embodiment of the present invention may be configured to equip the image recording apparatus 20 internally with the imaging apparatus 35 and make the image recording apparatus 20 calculate a correction parameter based on the detection result of the present imaging apparatus 35, in lieu of being limited to the configuration shown in FIG. 4.

Figure 6:
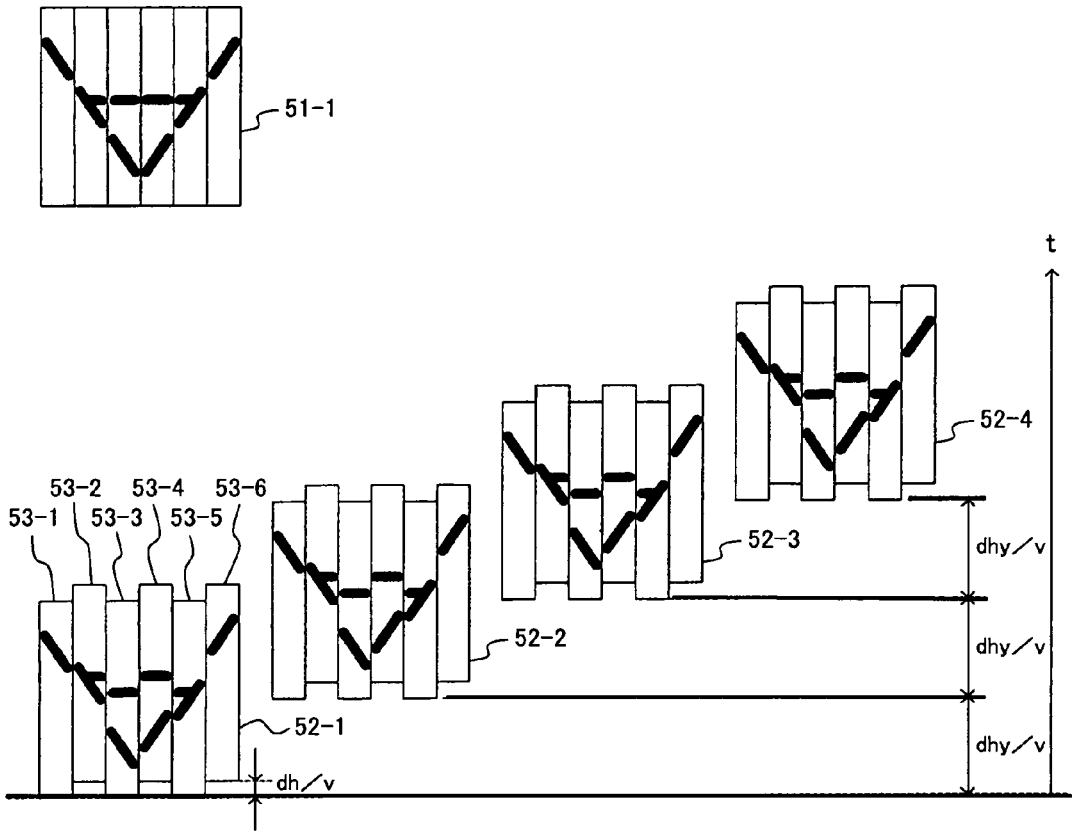
FIG. 6 is a diagram describing a result of recording an image, and a state of recording an image by using recording units of individual four colors at the clock time t, both in an image recording apparatus comprising four recording units, corresponding to four colors, in which six pieces of nozzle arrays are arrayed mutually staggeringly.

The next is a description on an operation of the recording data generation unit 26 by referring to FIG. 6.

Note that FIG. 6 exemplifies a configuration in which the line head of the nozzle arrays 33-1-1 through 33-n-m comprise six nozzle arrays as shown in the above described FIG. 2 and in which four of the thus configured line heads are placed parallelly in the conveying direction for responding to recording a color image.

An image 51-1 shown in FIG. 6 indicates a result of an image recording as a result of recording the image by the individual line heads corresponding to the four color inks on the recording medium 43.

In a description of FIG. 6, assuming that these four individual-color line heads are placed in the sequence of black (K), cyan (C), magenta (M) and yellow (Y) from the upstream side of the conveying path of the recording medium 43, the recording data of image-recorded colors by the clock time t are shown as: the numeral 52-1 for "K", the 52-2 for "C", the 52-3 for "M" and the 52-4 for "Y", respectively.

The respective pieces of color recording data 52-1 through 52-4 shown in FIG. 6 are distributed as corresponding to six nozzle arrays 33 in the respective strips shown in the drawing. For the recording data 52-1 as an example, the recording data 52-1 is distributed to the pieces of recording data 53-1 through 53-6 corresponding to six nozzle arrays 33 constituting the K-color line head.

The six nozzle arrays constituting the K-color line head, i.e., the nozzle arrays 33-1 through 33-6, are placed staggeringly in the distance of dh in the conveying direction of the recording medium 43. By this, it is necessary to record an image by using the nozzle array on the upstream side in the conveying path of the recording medium 43, followed by recording an image by using the nozzle array on the downstream side in the conveying path of the recording medium 43 after the recording medium is conveyed by the distance of dh, for the image recording of the recording data 52-1.

In an image recording by using the nozzle array on the downstream side in the conveying path of the recording medium 43, assuming that the conveying velocity thereof is v, there is a time delay of dh/v from the nozzle array on the upstream side in the conveying path of the recording medium 43 recording image.

Therefore, the recording data 53-2, 53-4 and 53-6 by the nozzle array on the downstream side in the conveying path of the recording medium 43 are delayed by the time dh/v as opposed to the recording data 53-1, 53-3 and 53-5 by the nozzle array on the upstream side in the conveying path of the recording medium 43.

Meanwhile, the K-color line head corresponding to the recording data 52-1 and the C-color line head corresponding to the recording data 52-2 are placed apart by the distance of dhy and in parallel with the conveying direction of the recording medium 43. By this, an image recording by the C-color line head is carried out when the recording medium 43 is conveyed by the distance of dhy after recording an image on the present recording medium 43 by the K-color head.

Therefore, an image recording by the C-color line head results in being delayed by the time of dhy/v from an image recording by the K-color line head on the recording medium 43.

Likewise, an image recording by the M-color line head results in being delayed by dhy/v from an image recording by the C-color line head, and an image recording by the Y-color line head is delayed by dhy/v from an image recording by the M-color line head.

As such, the recording data generation unit 26 carries out a delaying process based on the distance dh between the nozzle array on the upstream side in the conveying path of the recording medium 43 and the nozzle array on the downstream side in the conveying path of the recording medium 43, both of which constitute the line head, in synchronous with the number of pulses of the rotary encoder signal at the conveying position information generation unit 30 taking the information of the recording medium detection unit 23 as trigger information, and a delaying process based on the distance dhy when placing the individual color line heads in parallel with one another.

Furthermore, the recording data generation unit 26 divides the recording data of "1" through "n" lines (where the n is an integer of no less than "2") in the recording data notified from the host apparatus 34 to the control unit 21 as described above into pieces of recording data for each of the nozzle arrays 33-1-1 through 33-n-m constituting the line head.

The next is a description on a configuration of the nozzle array drive timing generation unit 27 and an operation of a nozzle array drive timing generation, according to the present embodiment, which is carried out at the nozzle array drive timing generation unit 27.

Figure 7:
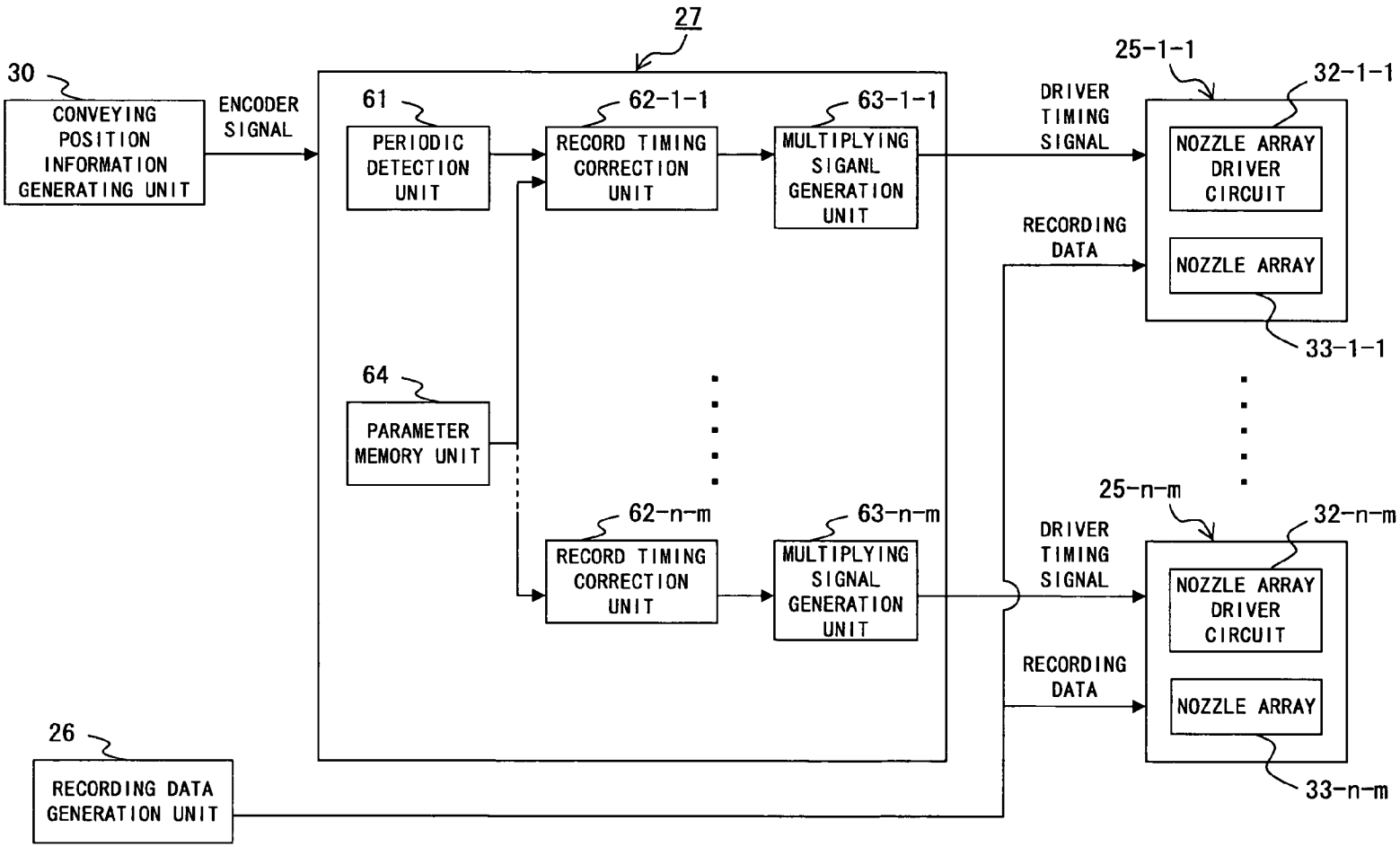
FIG. 7 is a diagram showing a configuration of a nozzle array drive timing generation unit according to a first embodiment of the present invention.

FIG. 7 is a diagram showing a configuration of a nozzle array drive timing generation unit according to the first embodiment of the present invention.

The nozzle array drive timing generation unit 27 receives an input of an encoder signal of the rotary encoder at the conveying position information generation unit 30, as an input signal as shown in FIG. 7.

A periodic detection unit 61 counts a prescribed clock pulse during a period of output pulse of the encoder signal, thereby detecting (i.e., measuring) a cycle of the output pulse of the encoder signal. A parameter memory unit 64 stores a timing correction parameter used by the individual record timing correction units 62-1-1 through 62-n-m for correction. The record timing correction units 62-1-1 through 62-n-m and multiplying signal generation units 63-1-1 through 62-n-m are equipped in correspondence with the individual nozzle arrays of the respective nozzle arrays 33-1-1 through 33-n-m. The record timing correction units 62-1-1 through 62-n-m calculate a correction parameter used by the corresponding nozzle arrays 33-1-1 through 33-n-m correcting recording data, and correct a timing of the recording data by using the correction parameter stored within the parameter memory unit 64. The multiplying signal generation units 63-1-1 through 63-n-m make the recording data generation unit 26 input image recording data to the respective recording units 25-1-1 through 25-n-m and output the respectively corresponding drive timing signals.

Figure 8:
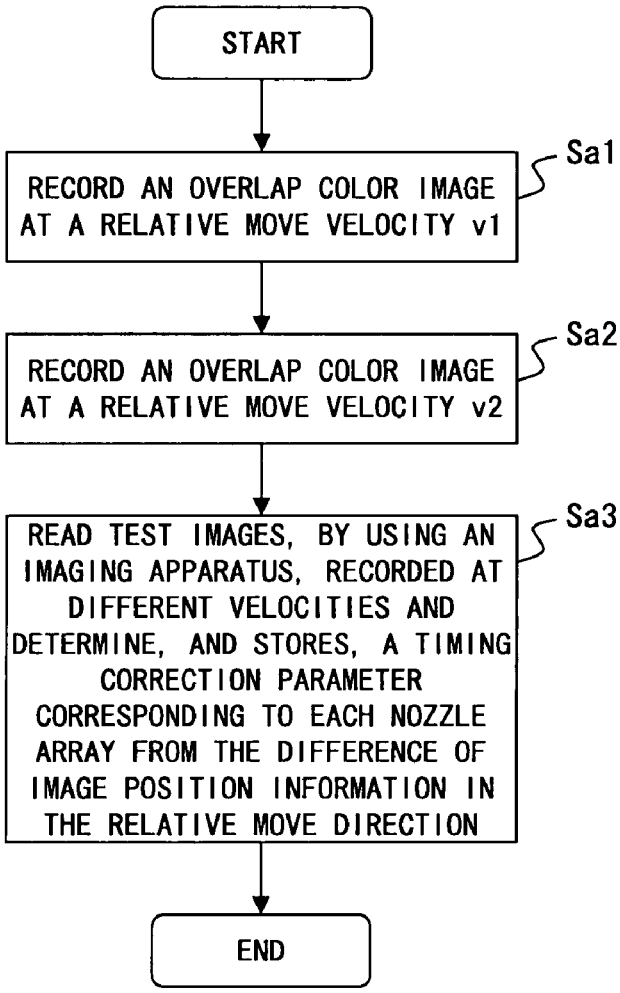
FIG. 8 is a flow chart showing the process for determining a timing correction parameter used by the nozzle array drive timing generation unit of an image recording apparatus according to the first embodiment of the present invention.

FIG. 8 is a flow chart showing the process for determining a timing correction parameter used by the nozzle array drive timing generation unit of an image recording apparatus according to the first embodiment of the present invention.

The determination of the timing correction parameter is carried out at the production process or adjustment process of the image recording apparatus in the factory for example. And the determined present timing correction parameter is stored in the parameter memory unit 64 described above.

When the process of FIG. 8 is started, the image recording apparatus 20 according to the first embodiment, first, records an image of a test image of overlap colors on the recording medium 43 by setting a relative move velocity between the recording medium 43 and the nozzle array 33-1-1 through 33-n-m as v1 in the step Sa1.

Then the image recording apparatus 20 according to the first embodiment records a test image of overlap colors on the recording medium 43 at a relative move velocity v2 which is different from the v1 in the step Sa2.

The test images recorded in the steps Sa1 and Sa2 is for detecting a misalignment in the relative move direction and therefore is a pattern such as a repetition of lines which are parallel with the nozzle arrays 33-1-1 through 33-n-m and which are perpendicular to the relative move direction for example.

Then in the step Sa3, the image recording apparatus 20 according to the first embodiment makes the above described imaging apparatus 35 read the test images for the different move velocities which have been image-recorded in the step Sa1 and Sa2, and determines and stores timing correction parameters corresponding to the respective nozzle arrays 33-1-1 through 33-n-m based on the difference of image position information of the readout images in the relative move direction.

In this event, the image recording apparatus 20 according to the first embodiment is enabled to determine a timing correction parameter with which a good correction effect is obtainable if setting the above described relative move velocity v1 as the minimum move velocity when recording an actual image, and the above described relative move velocity v2 as the maximum move velocity when recording an actual image.

Figure 9:
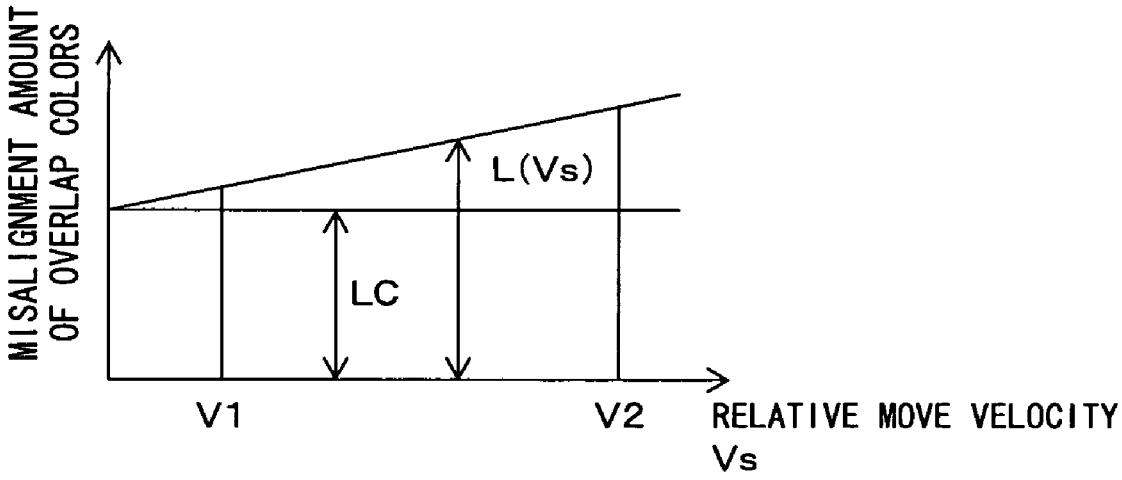
FIG. 9 is a diagram exemplifying a relationship between a misalignment amount of overlap colors in a relative move direction and a relative move velocity of a recording medium with each nozzle array.

FIG. 9 exemplifies a relationship between a misalignment amount of overlap colors in a relative move direction and a relative move velocity of a recording medium 43 with the individual nozzle arrays 33-1-1 through 33-n-m which is calculated from the test images when recording an image with an initial parameter based on design information of the image recording apparatus 20 in the above described steps Sa1 and Sa2.

The misalignment amount of overlap colors in this event is a position misalignment amount, in the relative move direction, between a recorded image by the K-color ink, for example, as reference color and a overlap color image recorded with another color ink and is easily calculated from a reading by the imaging apparatus 35 or an image process after the reading.

As an example, the misalignment amount of overlap colors L (Vs) of an image recorded by two nozzle arrays A and B at the relative velocity Vs is a sum of a component related to the relative move velocity Vs and a component LC unrelated to the relative move velocity Vs such as a position errors of the respective nozzle array A and B and a variation of an ink droplet jetting direction angle.

Where the ink droplet flying velocity of the nozzle array A: VdA, the ink droplet flying velocity of the nozzle array B: VdB, the distance between the nozzle A and recording medium 43: GA, and the distance between the nozzle B and recording medium 43: GB, then a misalignment amount of overlap colors L1 of an image recorded by the nozzle arrays A and B at the relative move velocity in the step Sa1 is calculated by the following expression (2) based on the above described expression (1):

$$L1=(GB/VdB-GA/VdA)\times V1+LC \quad (2)$$

Note that the distance GA between the nozzle array A and recording medium 43 and the distance GB between the nozzle array B and recording medium 43 are calculated based on thickness information of the recording medium 43 input from the mode setting unit 24.

Likewise, a misalignment amount of overlap colors L2 when recording an image at the relative move velocity V2 in the step Sa2 is calculated from the following expression (3):

$$L2=(GB/VdB-GA/VdA)\times V2+LC \quad (3)$$

Meanwhile, a misalignment amount of overlap colors L (Vs) when recording an image by the nozzle array A at the relative move velocity V3 followed by recording an image by the nozzle array B at the relative move velocity Vs after an acceleration is calculated from the following expression (4):

$$L(Vs)=(GB/VdB)\times Vs-(GA/VdA)\times V3+LC \quad (4)$$

A strict misalignment amount of overlap colors L (Vs) cannot be obtained unless the relative move velocity V3 is measured and stored, as shown in the expression (4).

The relative move velocity V3, however, can be estimated by various methods, such as from an acceleration at the relative move velocity Vs.

Here, the description is on the case of a relative move velocity being small, hence allowing an obtainment of a correction effect by an approximation of the following expression (5).

$$V3\approx Vs \quad (5)$$

An approximation of the expression (5) makes the expression (4) as the following expression (6):

$$L(Vs)=(GB/VdB-GA/VdA)\times Vs+LC \quad (6)$$

Then, the following expression (7) can be led from the expressions (2), (3) and (6):

$$L(Vs)=(L2-L1)/(V2-V1)\times Vs+[L1+L2-(L2-L1)\times(V1+V2)/(V2-V1)]/2 \quad (7)$$

A misalignment amount of overlap colors L (Vs) when recording an image at the relative move velocity Vs can easily be estimated from the L1 and L2 measured by reading a test image by using the imaging apparatus 35 as shown in the expression (7) in the step Sa3.

The timing correction parameter is obtained by calculating a coefficient for correcting a misalignment amount of overlap colors based on the expression (7), and stored by the parameter memory unit 64.

Then, at the time of recording an image, the nozzle array drive timing generation unit 27 makes the individual record timing correction units 62-1-1 through 62-n-m arithmetically operate correction amounts by using the timing correction parameter (i.e., a coefficient for correcting a misalignment amount of overlap colors) stored in the parameter memory unit 64 and the relative move velocity Vs detected at the periodic detection unit 61.

Note that a timing correction amount for the relative move velocity Vs may be put together in a table by arithmetically operating in advance and stored in the parameter memory unit 64.

While the case of a correction effect is obtained by an approximation of the expression (5) has been described above, for a simplicity of description; if an acceleration of the relative move velocity is large, however, an assumption of the relative move velocity being a constant or such makes it possible to estimate a relative move velocity V3, in accuracy corresponding to the assumption, at the time of recording an image by the nozzle array A as shown in the expression (4), and obtain a correction effect as a result.

A timing correction amount is varied by the distance GA between the nozzle array A and recording medium 43 and the distance GB between the nozzle B and recording medium 43 as shown in the expression (4).

A most optimal correction value for a timing correction amount, however, may sometimes be obtainable by changing expressions of correction depending on a recording velocity area. This makes it possible to input a timing correction value for a setting from the mode setting unit 24 by way of the thickness information of the recording medium 43 and of the information of a recording velocity as an image recording mode. And the timing correction amount allows a change of its correction amount in accordance with the input setup image recording mode.

Therefore, the nozzle array drive timing generation unit 27 is enabled to store a plurality of timing correction parameters corresponding to the image recording modes in the parameter memory unit 64 and carry out the selection and arithmetic operation of the most optimal timing correction parameter based on the image recording mode which includes the selection of a recording velocity mode and the thickness information of the recording medium 43 which have been input by the operator for an operation instruction by operating on the mode setting unit 24.

Figure 10:
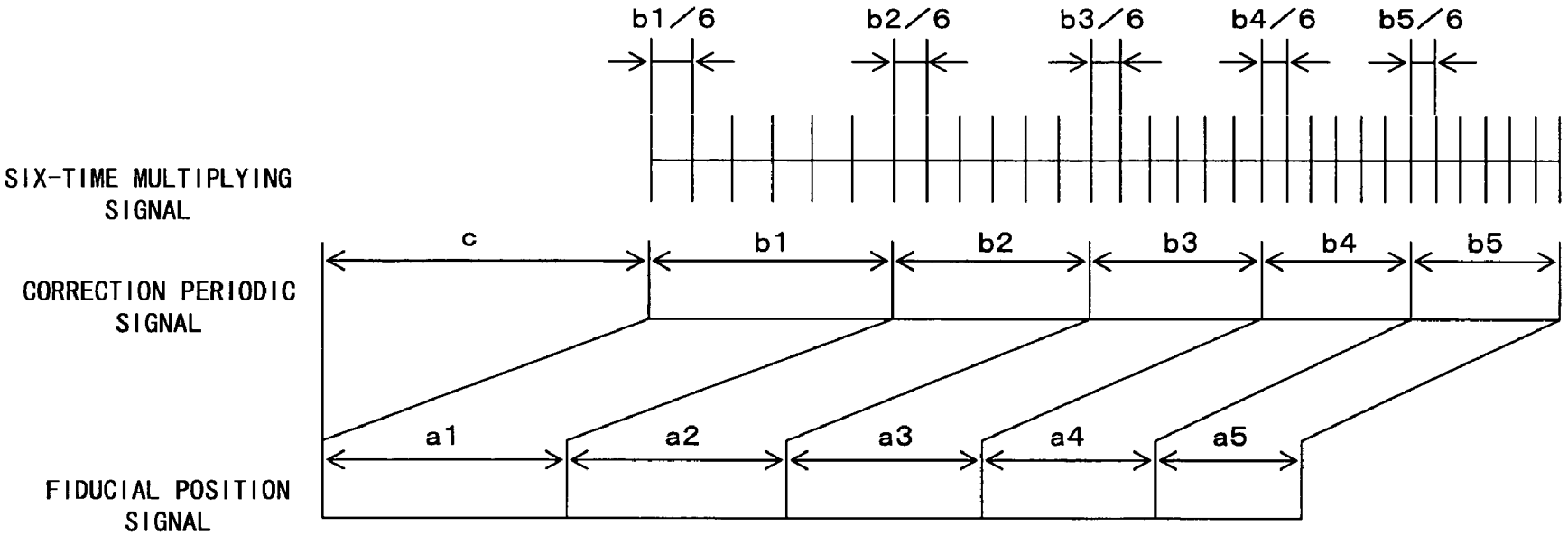
FIG. 10 is a diagram describing an operation of a relative move velocity in an acceleration area.

FIG. 10 is a diagram describing an operation of a relative move velocity in an acceleration area, showing an encoder pulse that is a fiducial position signal, a correction periodic signal and a six-time multiplying signal of the correction periodic signal.

FIG. 10 describes an operation at a relative move velocity, that is, in the acceleration area of the conveying velocity of the recording medium 43, with the lowest part showing a 150 dpi encoder pulse for example, that is a fiducial position signal. FIG. 10 also shows a correction periodic signal in the middle part and a six-time multiplying signal of the correction periodic signal in the upper part.

The fiducial position signal in the lowest part of FIG. 10 shows periods detected (i.e., measured) by the periodic detection unit 61, which is for the acceleration area of the relative move velocity and therefore the period becomes shorter in the sequence of a1, a2, a3, a4 and a5.

The correction periodic signals b1, b2, b3, b4 and b5, which are shown in the lowest part of FIG. 10, are a results of correcting the detection periods a1, a2, a3, a4 and a5 by the record timing correction units 62-1-1 through 62-n-m by considering ink landing position shifts due to the flight in the relative move direction (i.e., the Y direction) calculated by the above described expression (1) and are values arithmetically operated by the record timing correction units 62-1-1 through 62-n-m based on the respective correction parameters.

A shift amount dy of an ink landing position in the relative move direction is the function of a temporally changing relative move velocity between the recording medium 43 and the nozzle arrays 33-1-1 through 33-n-m and also changed by the flight velocity Vd of an ink droplet and by the distance G between the nozzle arrays 33-1-1 through 33-n-m and recording medium 43, as described by the above noted expression (1).

The flight velocity Vd of an ink droplet is varied by the individual nozzle arrays 33-1-1 through 33-n-m. And the distance G between the nozzle arrays 33-1-1 through 33-n-m and recording medium 43 is varied by the individual nozzle arrays 33-1-1 through 33-n-m. Furthermore, the jet direction angles of the individual nozzles of the nozzle arrays 33-1-1 through 33-n-m are also varied by the individual nozzle arrays 33-1-1 through 33-n-m.

The nozzle array drive timing generation unit 27 according to the first embodiment of the present invention comprises the record timing correction units 62-1-1 through 62-n-m for the respective nozzle arrays 33-1-1 through 33-n-m and the record timing correction units 62-1-1 through 62-n-m calculate correction values of the recording timings based on the correction parameters for the respective nozzle arrays 33-1-1 through 33-n-m, and therefore the nozzle array drive timing generation unit 27 is enabled to correct recording timings respectively corresponding to a various variation in each of the above described nozzle arrays.

The c shown in the middle part of FIG. 10 is a constant delay time which is set for correcting a period after the periodic detection unit 61 detecting it and which is a value satisfying the following expression (8):

$$c>a1+\text{ maximum correction value} \quad (8)$$

Meanwhile, the uppermost part of FIG. 10 shows an example of generating a six-time multiplying signal of the correction periodic signal.

The individual multiplying signals are respectively determined by dividing correction periods b1, b2, b3, b4 and b5 by a multiplying number at respective multiplying signal generation units 63-1-1 through 63-n-m. The individual multiplying signal generation units 63-1-1 through 63-n-m generate multiplying signals at a delay time c, followed by generating the next multiplying signals by counting a prescribed clock pulse.

The nozzle array drive timing generation unit 27 outputs these multiplying signals to the recording units 25-1-1 through 25-n-m, thereby being capable of making the present recording units 25-1-1 through 25-n-m record an image at a nozzle array drive timing corresponding to the resolution of 900 dpi.

The nozzle array drive timing generation unit 27 also generates a nozzle array drive timing selectively by shifting a timing by using the multiplying signal, thereby being capable of carrying out a fine timing adjustment shorter than a cycle of an encoder signal even when recording an image not in higher resolution than the encoder signal.

The next is a description on an operation of the nozzle array drive timing generation unit 27 according to the first embodiment of the present invention.

Figure 11:
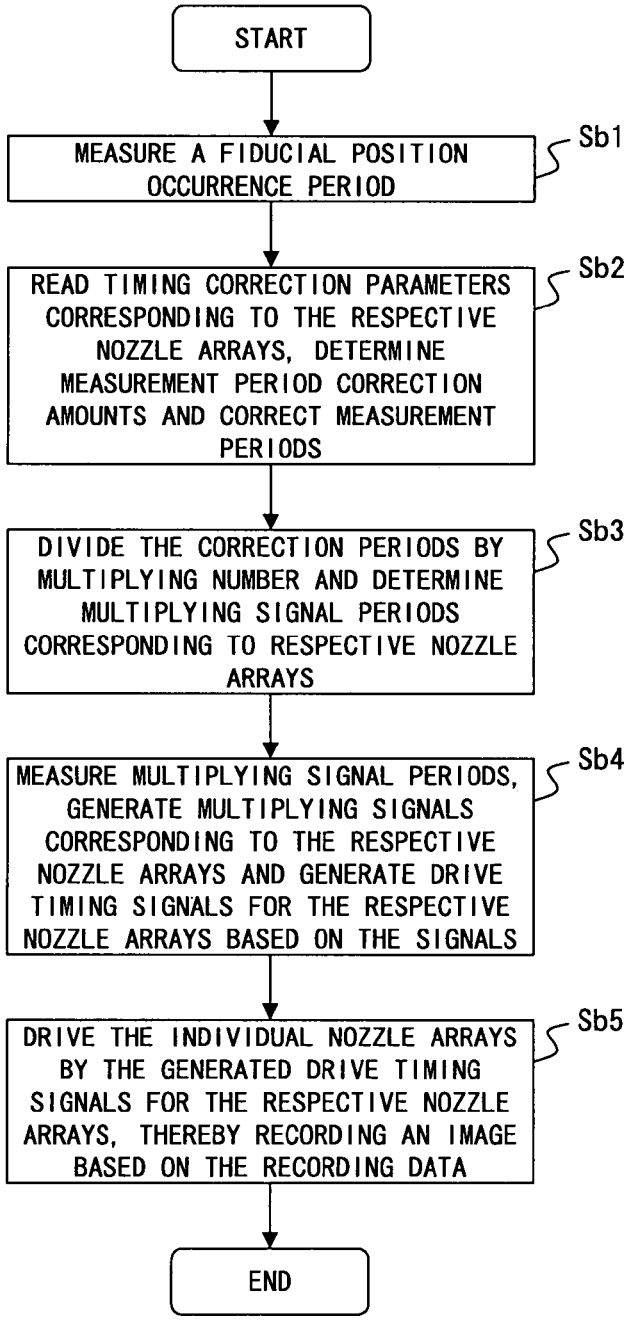
FIG. 11 is a flow chart showing an operation process of the nozzle array drive timing generation unit according to the first embodiment of the present invention.

FIG. 11 is a flow chart showing an operation process of the nozzle array drive timing generation unit according to the first embodiment of the present invention.

The nozzle array drive timing generation unit 27 according to the first embodiment first detects (i.e., measures) an occurrence period of encoder pulses of 150 dpi for example that is a fiducial position signal by using the periodic detection unit 61 in the step Sb1.

Then, the nozzle array drive timing generation unit 27 according to the first embodiment reads the timing correction parameters corresponding to the respective nozzle arrays 33-1-1 through 33-n-m from the parameter memory unit 64, determines measurement period correction amounts and corrects measurement periods in the step Sb2 based on the occurrence periods of the encoder pulses detected in the step Sb1. In this event, the most optimal timing correction parameter is selected from among a plurality thereof which is set in the parameter memory unit 64 corresponding to the image recording mode which is set in the mode setting unit 24.

Then in the step Sb3, the nozzle array drive timing generation unit 27 according to the first embodiment divides the correction periods corrected in the step Sb2 by the multiplying number by the individual multiplying signal generation units 63-1-1 through 63-n-m and determines respective multiplying signal periods corresponding to the individual nozzle arrays 33-1-1 through 33-n-m.

Then in the step Sb4, the nozzle array drive timing generation unit 27 according to the first embodiment measures multiplying signal periods, generates respective multiplying signals corresponding to the individual nozzle arrays 33-1-1 through 33-n-m and generates drive timing signals for the respective nozzle arrays 33-1-1 through 33-n-m based on the multiplying signals.

Then in the step Sb5, the nozzle array drive timing generation unit 27 according to the first embodiment drives the individual nozzle array driver circuits 32-1-1 through 32-n-m by the drive timing signals for the respective nozzle arrays 33-1-1 through 33-n-m generated in the step Sb4 based on the recording data (i.e., distributed recording data) output from the recording data generation unit 26, thereby recording an image.

As described above, the image recording apparatus 20 according to the first embodiment of the present invention is configured such that the nozzle array drive timing generation unit 27 stores a plurality of timing correction parameters corresponding to the image recording mode in the parameter memory unit 64, and selects, and arithmetically operates, the most optimal timing correction parameter based on the image recording mode having the selection of a recording velocity mode and the thickness information of the recording medium 43 which have been input by the operator for an operation instruction by way of the mode setting unit 24.

By this configuration, the image recording apparatus 20 according to the first embodiment of the present invention is enabled to carry out an image recording without causing a shift of a landing dot for each of the nozzle arrays 33-1-1 through 33-n-m against the recording medium 43 even if there is a variation in jetting characteristic for each of the nozzle arrays 33-1-1 through 33-n-m and/or there is an error in the mounting positions of the individual nozzle arrays 33-1-1 through 33-n-m, and furthermore, even if the relative move velocity of the recording medium 43 with the individual nozzle arrays 33-1-1 through 33-n-m is not only in a fixed velocity area but also in an acceleration area or a deceleration area.

Figure 12:
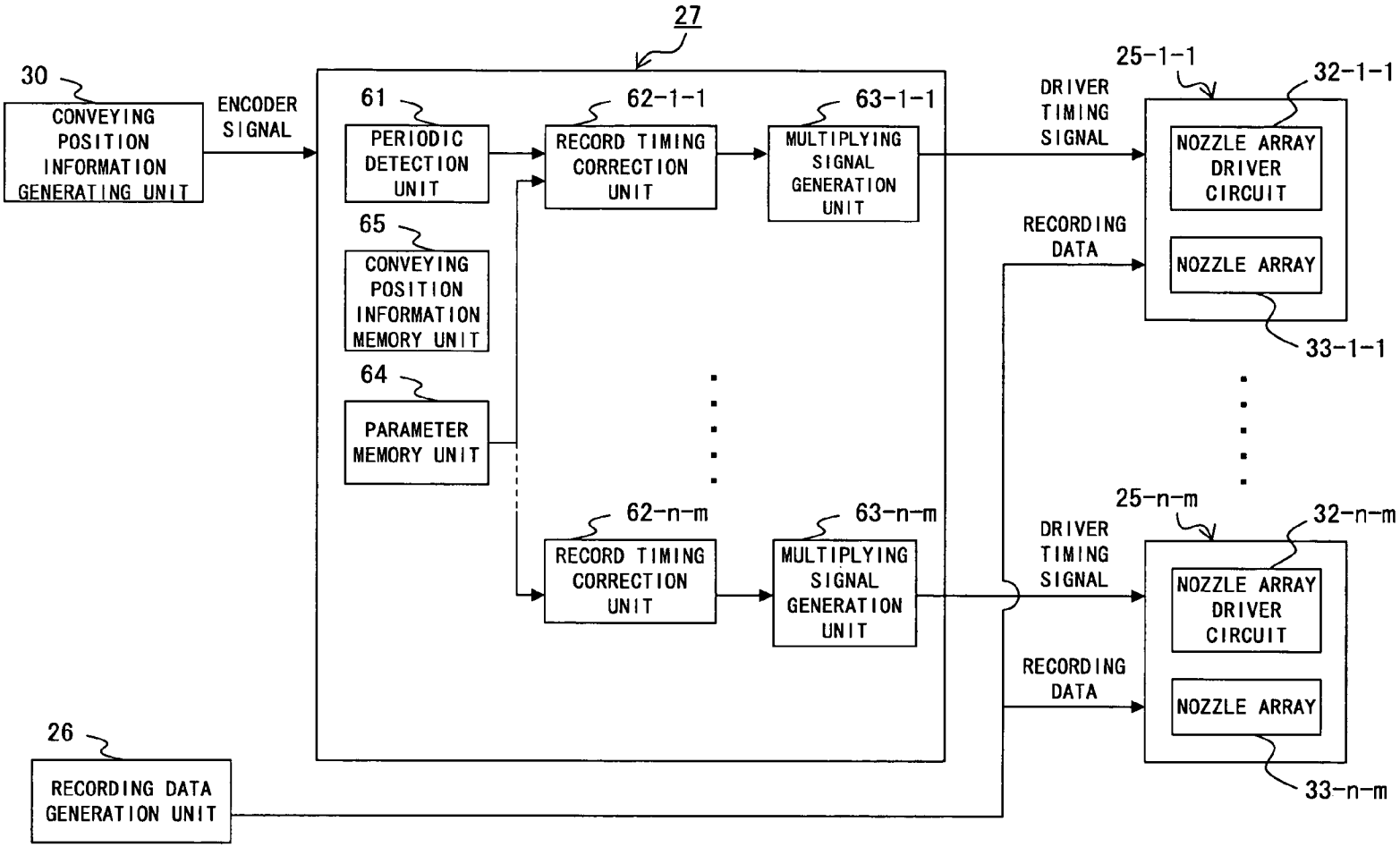
FIG. 12 is a diagram showing a configuration of a nozzle array drive timing generation unit according to a second embodiment of the present invention.

FIG. 12 is a diagram showing a configuration of a nozzle array drive timing generation unit according to a second embodiment of the present invention.

Note that the same component sign is assigned to the constituent component which is common to the above described first embodiment in the description of the present second embodiment and the description here is concentrated on the part different from the first embodiment.

A nozzle array drive timing generation unit 27 according to the second embodiment of the present invention is configured differently from the nozzle array drive timing generation unit 27 according to the above described first embodiment of the present invention where a conveying position information memory unit 65 is added anew.

The nozzle array drive timing generation unit 27 according to the second embodiment of the present invention stores a relative move velocity by correlating with the coordinate of the relative move as needed in the conveying position information memory unit 65 in the relative move of a recording medium 43 with nozzle arrays 33-1-1 through 33-n-m. In this event, the relative move velocity is calculated from an output pulse period of an encoder detected at a periodic detection unit 61.

Figure 13:
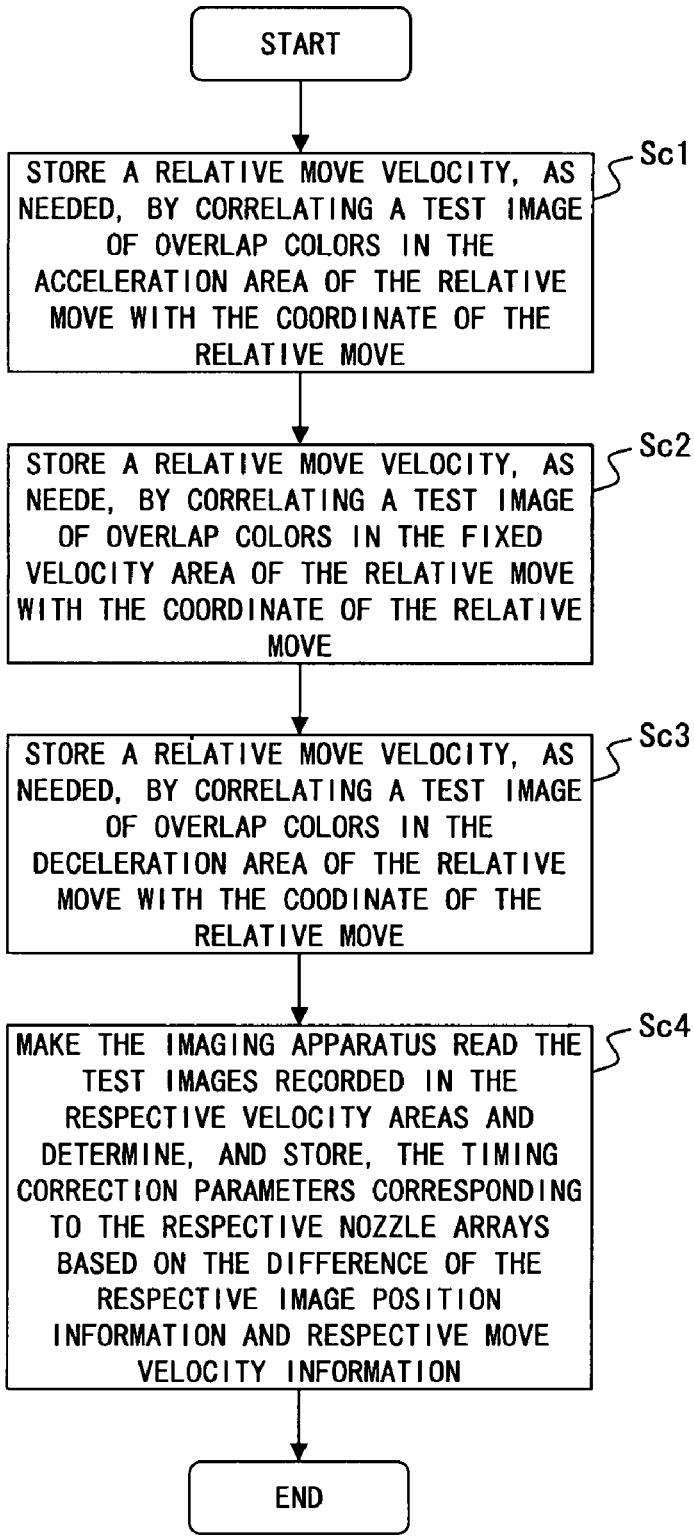
FIG. 13 is a flow chart showing the process for determining a timing correction parameter used by the nozzle array drive timing generation unit according to the second embodiment of the present invention.

FIG. 13 is a flow chart showing the process for determining a timing correction parameter used by the nozzle array drive timing generation unit of the image recording apparatus according to the second embodiment of the present invention.

The timing correction parameter is determined in advance of a common image recording, e.g., at the production process or adjustment process of the image recording apparatus at the factory. And the determined present timing correction parameter is stored in the above described parameter memory unit 64.

When the process of FIG. 13 is started, an image recording apparatus 20 according to the present second embodiment first records, on the recording medium 43, the image of an overlap color image in the relative move acceleration area in which the relative velocity between the recording medium and nozzle arrays 33-1-1 through 33-n-m is in acceleration, in the step Sc1. In this event, the image recording apparatus 20 according to the second embodiment stores the relative move velocity by correlating with the coordinate of the move as needed in the conveying position information memory unit 65 as well as recording the overlap color image.

Then, the image recording apparatus 20 according to the second embodiment records the image of an overlap color image in the fixed velocity area of the relative move in which the relative velocity between the recording medium 43 and nozzle arrays 33-1-1 through 33-n-m is in fixed velocity, in the step Sc2. Also in this event, the image recording apparatus 20 according to the second embodiment stores the relative move velocity by correlating with the coordinate of the move as needed in the conveying position information memory unit 65 as well as recording the overlap color image.

Then, the image recording apparatus 20 according to the second embodiment records the image of an overlap color image in the deceleration area of the relative move, in which the relative velocity between the recording medium 43 and nozzle arrays 33-1-1 through 33-n-m is in deceleration, in the step Sc3. Also in this event, the image recording apparatus 20 according to the second embodiment stores the relative move velocity by correlating with the coordinate of the move as needed in the conveying position information memory unit 65, as well as recording the overlap color image, likewise in the steps Sc1 and Sc2.

As such in the present determination process, the image recording apparatus 20 records the image of the overlap color images not only in the fixed velocity area of the relative move but also in the relative move acceleration area and relative move deceleration area, and also stores the relative move velocity by correlating with the coordinate of the relative move as needed in the conveying position information memory unit 65.

Then, the image recording apparatus 20 according to the second embodiment makes the imaging apparatus 35 read the test images recorded in the steps Sc1, Sc2 and Sc3, determines timing correction parameters corresponding to the respective nozzle arrays 33-1-1 through 33-n-m based on the difference of the image position information among the read images in the relative move direction and stores the parameters in the parameter memory unit 64 in the step Sc4.

The test images stored in the steps Sc1 through Sc3 are for detecting the misalignments in the relative move direction and therefore use a pattern such as a repetition of lines perpendicular to the relative move direction and parallel with the nozzle arrays 33-1-1 through 33-n-m for example.

And the test image desirably shows clearly the relationship with the coordinate of the relative move by investing it with a scale in correlation with the coordinate of the relative move or such.

The image recording apparatus 20 according to the second embodiment makes the imaging apparatus 35 read the test images, thereby detecting a misalignment in the relative move direction which is correlated with the coordinate of the relative move.

The image recording apparatus 20 according to the second embodiment records an image with the nozzle array A at the relative move velocity V3, followed by accelerating and recording an image with the nozzle array B at the relative move velocity Vs during an acceleration of the relative move velocity as described in the description of the image recording apparatus 20 according to the first embodiment of the present invention.

The misalignment amount of overlap colors L (Vs) in this event is represented by the expression (4).

And, the relative move velocity V3 represented by the expression (5) can be obtained by reading the relative move velocity correlated with the coordinate of the relative move, which is stored in the conveying position information memory unit 65.

The nozzle array drive timing generation unit 27 of the image recording apparatus 20 according to the second embodiment is enabled to correct the recording timing of the respective nozzle arrays 33-1-1 through 33-n-m in high accuracy, comparable to the nozzle array drive timing generation unit 27 of the image recording apparatus 20 according to the first embodiment, even if the acceleration of the relative move velocity is so large, and fluctuating, as to preclude a use of the approximation of the expression (5).

Figure 14:
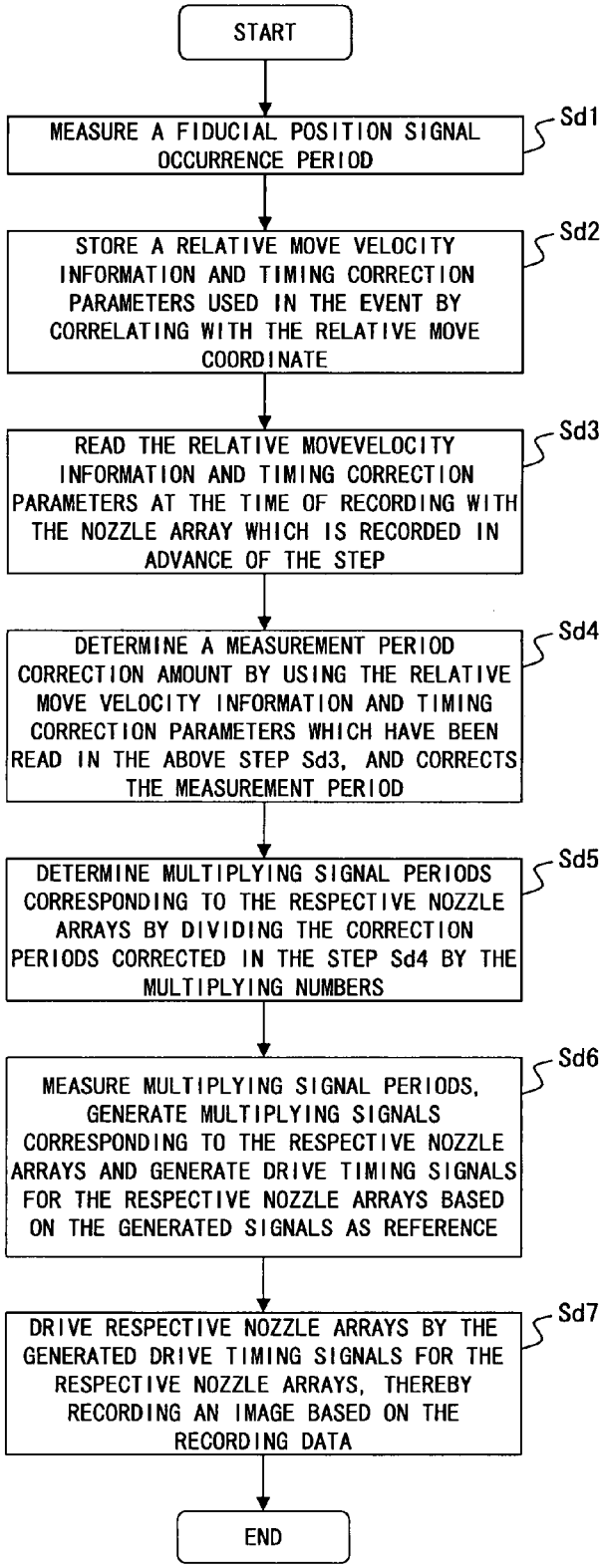
FIG. 14 is a flow chart showing an operation process of the nozzle array drive timing generation unit according to the second embodiment of the present invention.

FIG. 14 is a flow chart showing an operation process of the nozzle array drive timing generation unit according to the second embodiment of the present invention.

In the first step Sd1, the nozzle array drive timing generation unit 27 according to the second embodiment detects (i.e., measures) an occurrence period of an encoder pulses of 150 dpi for example, that is a fiducial position signal, by using the periodic detection unit 61.

Note that the process of the step Sd1 is the same as that of the step Sb1 shown in the above described FIG. 11.

Then the nozzle array drive timing generation unit 27 according to the second embodiment, while recording an image on the recording medium 43, stores, in the conveying position information memory unit 65, the information of the relative move velocity between the recording medium 43 and individual nozzle arrays 33-1-1 through 33-n-m and the timing correction parameter used in the event by correlating with the relative move coordinates in the step Sd2.

Then, the nozzle array drive timing generation unit 27 according to the second embodiment reads the relative move velocity information and timing correction parameter at the time of recording by the respective nozzle arrays 33-1-1 through 33-n-m, which are stored in advance of the present step, from the conveying position information memory unit 65 in the step Sd3.

Then, the nozzle array drive timing generation unit 27 according to the second embodiment determines a measurement period correction amount by using the relative move velocity information and timing correction parameter read in the above described step Sd3 and corrects the measurement period in the step Sd4.

Then, the nozzle array drive timing generation unit 27 according to the second embodiment determines multiplying signal periods corresponding to the respective nozzle arrays 33-1-1 through 33-n-m by dividing the correction periods corrected in the step Sd4 by the multiplying numbers for the respective multiplying signal generation units 63-1-1 through 63-n-m in the step Sd5.

Then, the nozzle array drive timing generation unit 27 according to the second embodiment measures multiplying signal periods, generates the multiplying signals corresponding to the respective nozzle arrays 33-1-1 through 33-n-m and generates the drive timing signals for the respective nozzle arrays 33-1-1 through 33-n-m based on the generated signals as reference in the step Sd6.

Then, the nozzle array drive timing generation unit 27 according to the second embodiment drives the individual nozzle array driver circuits 32-1-1 through 32-n-m by the drive timing signals for the respective nozzle arrays 33-1-1 through 33-n-m generated, in the step Sb4, on the basis of the recording data (i.e., distributed recording data) output from the recording data generation unit 26, thereby recording an image in the step Sd7.

As described above, the image recording apparatus 20 according to the second embodiment of the present invention is configured such that the nozzle array drive timing generation unit 27 stores a plurality of timing correction parameters corresponding to image recording modes in the parameter memory unit 64 and selects, and arithmetically operates, the most optimal timing correction parameter based on the image recording mode having information such as the selection of a recording velocity mode and thickness of the recording medium 43 which have been input by an operator for an operation instruction by operating on the mode setting unit 24.

By this configuration, the image recording apparatus 20 according to the second embodiment of the present invention is enabled to record an image on the recording medium 43 without causing a misalignment of an ink landing dot for each of the nozzle arrays 33-1-1 through 33-n-m, even if there is a variation of jetting characteristics of the individual nozzle arrays 33-1-1 through 33-n-m and/or an error in the mounting positions of the individual nozzle arrays 33-1-1 through 33-n-m and further, the relative velocity of the recording medium 43 with the individual nozzle arrays 33-1-1 through 33-n-m in not only in the fixed velocity area but also in the acceleration area or deceleration area.

Also, the image recording apparatus 20 according to the second embodiment of the present invention is configured to store information of the relative move velocity between the recording medium 43 and individual nozzle arrays 33-1-1 through 33-n-m and the timing correction parameters used in the event by correlating with the relative move coordinates in the conveying position information memory unit 65 while recording an image of the recording medium 43. And the image recording apparatus 20 according to the second embodiment of the present invention is configured to use the information stored in the conveying position information memory unit 65 for the image recording thereafter, thereby being enabled to correct the recording timings of the respective nozzle arrays 33-1-1 through 33-n-m even if the acceleration of the relative move velocity is so large, and fluctuating, as to preclude a use of an approximation of the above described expression (5).

The above described image recording apparatuses 20 according to the first and second embodiments of the present invention are configured to equip four recording units of 25-1-1 through 25-n-m so as to accommodate four ink colors of black (K), cyan (C), magenta (M) and yellow (Y); the comprisal of the present invention, however, may include a recording unit corresponding to an additional color or include recording units accommodating no more than three colors, in lieu of being limited to the above described embodiments.

Meanwhile, the above described image recording apparatuses 20 according to the first and second embodiment of the present invention have exemplified the configurations of so-called full line type image recording apparatus fixedly placing recording units; the comprisal of the present invention, however, can be applied to a serial scan type image recording apparatus alternately performing a reciprocal movement of a carriage mounting a recording head(s) and of conveying of a recording medium, in lieu of being limited to the above described embodiments.

The above described image recording apparatuses 20 according to the first and second embodiments of the present invention are enabled to record an image even in the acceleration and deceleration areas at both end area of the moving range of the carriage as described above when the present apparatuses 20 are applied to a serial scan type image recording apparatus, thereby making it possible to improve a throughput of an image recording and also make the apparatus compact as much as eliminating the necessity of securing a space for the acceleration and deceleration areas.

What is claimed is:

1. An image recording apparatus having at least one recording unit arraying a plurality of nozzle arrays featured with a plurality of nozzles for jetting a single color ink onto a recording medium and recording an image by relatively moving the recording unit and the recording medium, comprising:

a parameter memory unit for storing an individual correction parameter considering an individual characteristic of each of the plurality of nozzle arrays; and a recording timing correction unit for individually correcting a recording timing of the corresponding each of the plurality of nozzle arrays by using the aforementioned correction parameter read out of the parameter memory unit.

2. The image recording apparatus according to claim 1, wherein the correction parameter is calculated from a difference of image recording position information in a relative move direction between a test pattern recording an image at a relative move velocity V1 of the recording medium relative to the nozzle array and a test pattern recording an image at a relative move velocity V2, of the recording medium relative to the nozzle array, which is different from the relative move velocity V1.

3. The image recording apparatus according to claim 2, wherein the correction parameter is calculated from the following expression:

$$L(Vs)=(L2-L1)/(V2-V1)\times Vs+[L1+L2-(L2-L1)\times(V1+V2)/(V2-V1)]/2, \text{ where}$$

L1 is a misalignment amount of overlap colors at the relative move velocity V1, L2 is a misalignment amount of overlap colors at the relative move velocity V2 and L(Vs) is a misalignment amount of overlap colors at the relative move velocity Vs between the recording medium and nozzle array.

4. The image recording apparatus according to claim 1, further comprising a mode setting unit for an operator to input and set a mode, wherein the parameter memory unit stores plural sets of the correction parameters corresponding to the mode, and the recording timing correction unit corrects the recording timings of the corresponding plurality of nozzle arrays, respectively, by using the correction parameters corresponding to the modes set by way of the mode setting unit.

5. The image recording apparatus according to claim 1, further comprising a conveying position information memory unit for storing a relative move velocity by correlating with coordinates of a relative move as needed at the time of recording an image, wherein the recording timing correction unit corrects recording timings of the corresponding plurality of nozzle arrays, respectively, by using the correction parameter read out of the parameter memory unit and the information stored in the conveying position information memory unit.

6. The image recording apparatus according to claim 5, wherein the correction parameter is calculated from a difference of image recording position information in the relative move direction among a test pattern recording an image in an acceleration area of a relative move in which a relative velocity of the recording medium with the nozzle array is in acceleration, a test pattern recording an image in a constant speed area in which a relative velocity of the recording medium with the nozzle array is fixed velocity and a test pattern recording an image in a deceleration area of a relative move in which a relative velocity of the recording medium with the nozzle array is in deceleration.

7. An image recording method for use in an image recording apparatus having at least one recording unit arraying a plurality of nozzle arrays featured with a plurality of nozzles for jetting a single color ink onto a recording medium and recording an image by relatively moving the recording unit and the recording medium, comprising:

correcting a recording timing of the corresponding each of plurality of nozzle arrays by using an individual correction parameter considering the individual characteristic of each of the plurality of nozzle arrays; and recording an image at the present recording timing corrected for each of the plurality of nozzle arrays.

8. The image recording method according to claim 7, wherein the individual characteristic of each of the plurality of nozzle arrays comprises:

a difference of jet direction of the ink from the plurality of nozzles in each of the present plurality of nozzle arrays, and a difference of individual mounting positions of the plurality of nozzle arrays.

* * * * *